US006164939A

United States Patent [19]

Chung et al.

[11] Patent Number: 6,164,939

[45] Date of Patent: Dec. 26, 2000

[54] SCROLL PUMP

[75] Inventors: Moon Ki Chung; Seong Bin Lee, both of Seoul, Rep. of Korea

[73] Assignee: LG Electronics Inc., Seoul, Rep. of Korea

[21] Appl. No.: 08/993,524

[22] Filed: Dec. 18, 1997

[30] Foreign Application Priority Data

Dec. 18, 1996 [KR] Rep. of Korea ..... 96-67391

[51] Int. Cl.[7] ..... F01C 1/30

[52] U.S. Cl. ..... 418/5; 418/55.1; 418/55; 417/203; 361/25

[58] Field of Search ..... 418/55.1, 5, 55; 361/25; 417/203

[56] References Cited

U.S. PATENT DOCUMENTS 4,865,530 9/1989 Nishida et al. ..... 418/55

5,200,872 4/1993 D'Entremont et al. ..... 361/25

5,338,159 8/1994 Riffe et al. ..... 417/203

5,616,015 4/1997 Liepert ..... 418/5

*Primary Examiner*—Thomas Denion

*Assistant Examiner*—Theresa Trieu

[57] ABSTRACT

A scroll pump comprising a fixed scroll, an orbiting scroll orbiting with a radius which is the same as the eccentric distance of an eccentric shaft to the center of the fixed scroll and contacting the fixed scroll, an inlet port formed in the middle of the upper side of the fixed scroll to influx incompressible hydraulic fluid into the scroll pump, a pressure chamber formed at the outside of the orbiting scroll to raise the pressure of the incompressible hydraulic fluid, and an outlet port formed at the side of the fixed scroll to discharge the incompressible hydraulic fluid from the scroll pump.

1 Claim, 3 Drawing Sheets

SCROLL PUMP

BACKGROUND OF THE INVENTION

The present invention relates to a scroll pump, and more particularly to a scroll pump which has an inlet port and an outlet port for pumping an incompressible hydraulic fluid from the inside to the outside of the pump.

FIG. 1 is a plan view of a conventional scroll pump.

As shown in FIG. 1, the conventional scroll pump comprises a fixed scroll 1, an orbiting scroll 3 which orbits according to the driving force of a motor (not shown in FIG. 1) and contacts the fixed scroll 1, an inlet port 5 formed at one side of the scroll pump for influxing an incompressible hydraulic fluid to the inside of the pump, and an outlet port 7 formed in the middle of the upper side of the scroll pump to discharge the incompressible hydraulic fluid from the pump to the outside.

In the operation of the conventional scroll pump, the orbiting scroll 3 simultaneously orbits according to the driving force of the motor and further orbits with contacting the fixed scroll 1. At this time, through the inlet port 5 the incompressible hydraulic fluid is introduced into the space between the fixed scroll 1 and the orbiting scroll 3. The incompressible hydraulic fluid is moved toward the center of the fixed scroll 1 by the orbiting of the orbiting scroll 3 and is then pumped out through the outlet port 7.

However, in the conventional scroll pump, the incompressible hydraulic fluid is moved by a contact part between the orbiting scroll 3 and the fixed scroll 1, whereby it is necessary to conduct with fine precision the contact part of said side so as to prevent the effluxion of the incompressible hydraulic fluid. Therefore, the manufacturing cost is increased.

Moreover, since the incompressible hydraulic fluid is moved from the outside to the inside of the pump, there is the risk that the motor may break down due to the centrifugal force of the incompressible hydraulic fluid, and furthermore, the outlet pressure of the incompressible hydraulic fluid pumped to the outside of the pump through the outlet port 7 may seriously decline.

SUMMARY OF THE INVENTION

Accordingly, it is an object of the present invention to provide a scroll pump that includes an inlet port and an outlet port for making the incompressible hydraulic fluid pump move from inside to outside the pump.

In order to realize this objective, the scroll pump of the present invention utilizes a fixed scroll, an orbiting scroll which contacts the fixed scroll, an inlet port formed at the middle portion of the upper side of the fixed scroll so as to influx the incompressible hydraulic fluid to the inside of the pump, a pressure chamber formed at the outside of the orbiting scroll so as to raise the pressure of the incompressible hydraulic fluid, and an outlet port formed at the side of the fixed scroll for pumping the incompressible hydraulic fluid to the outside of the scroll pump.

The orbiting scroll orbits with a radius which is the same as the eccentric distance of an eccentric shaft to the center of the fixed scroll, and constantly maintains a certain distance with respect to the fixed scroll, both horizontally and vertically.

In the operation of the conventional scroll pump, because the incompressible hydraulic fluid is introduced from the side of the scroll pump and pumped to the outside through the middle of the upper side of the scroll pump, the centrifugal force and inertia force of the incompressible hydraulic fluid are generated at the contact part as a resistance. Therefore, it causes the effluxion of the incompressible hydraulic fluid, requiring fine precision of the contact part.

However, in the operation of the present scroll pump, the centrifugal force of the incompressible hydraulic fluid promotes the pumping activity and makes no resistance to the contact part, that is, the centrifugal force acts reversely against the contact part. Hence, the effluxion is prevented and it helps to increase the pressure of the incompressible hydraulic fluid, and then the pressure for discharging of the incompressible hydraulic fluid increases to the proper pressure by rotating of the incompressible hydraulic fluid in the pressure chamber.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

DETAILED DESCRIPTION OF THE INVENTION

Hereinafter, the scroll pump of the present invention is explained in detail with reference to the drawings.

Figure 1:
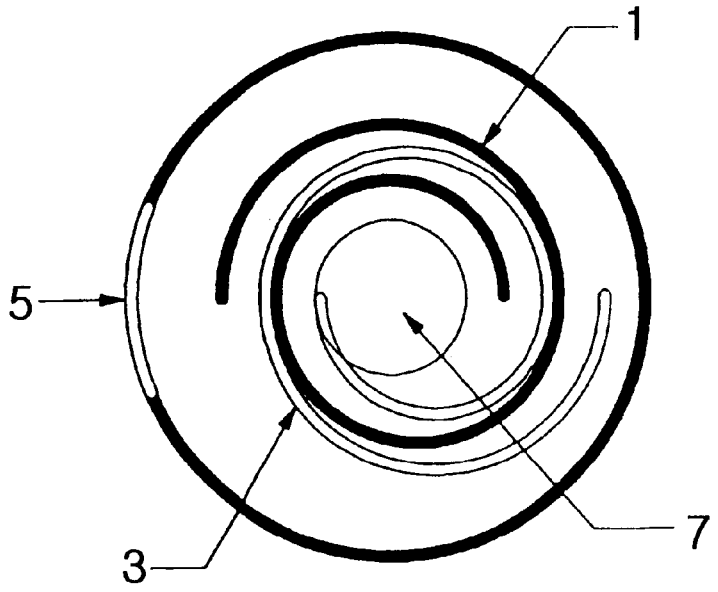
FIG.1 PRIOR ART
FIG. 1 is a plan view of the conventional scroll pump.
Figure 2:
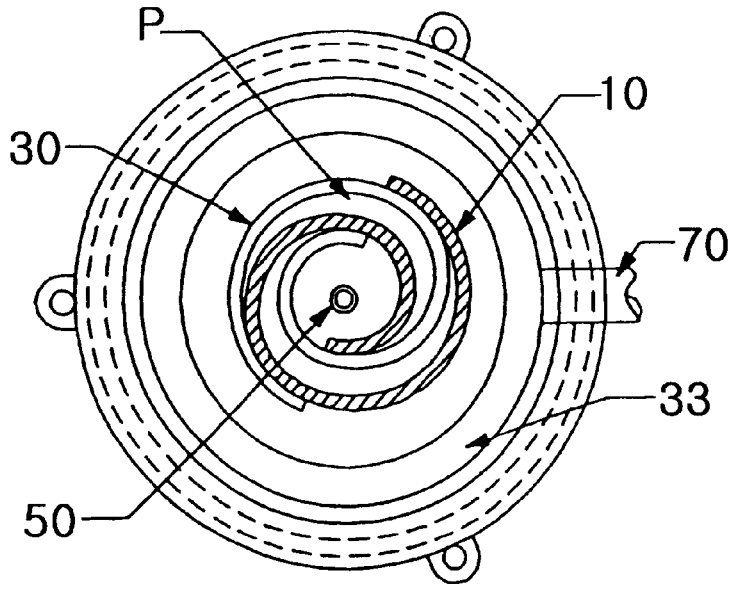
FIG. 2 is a plan view of the scroll pump of the present invention.
Figure 3:
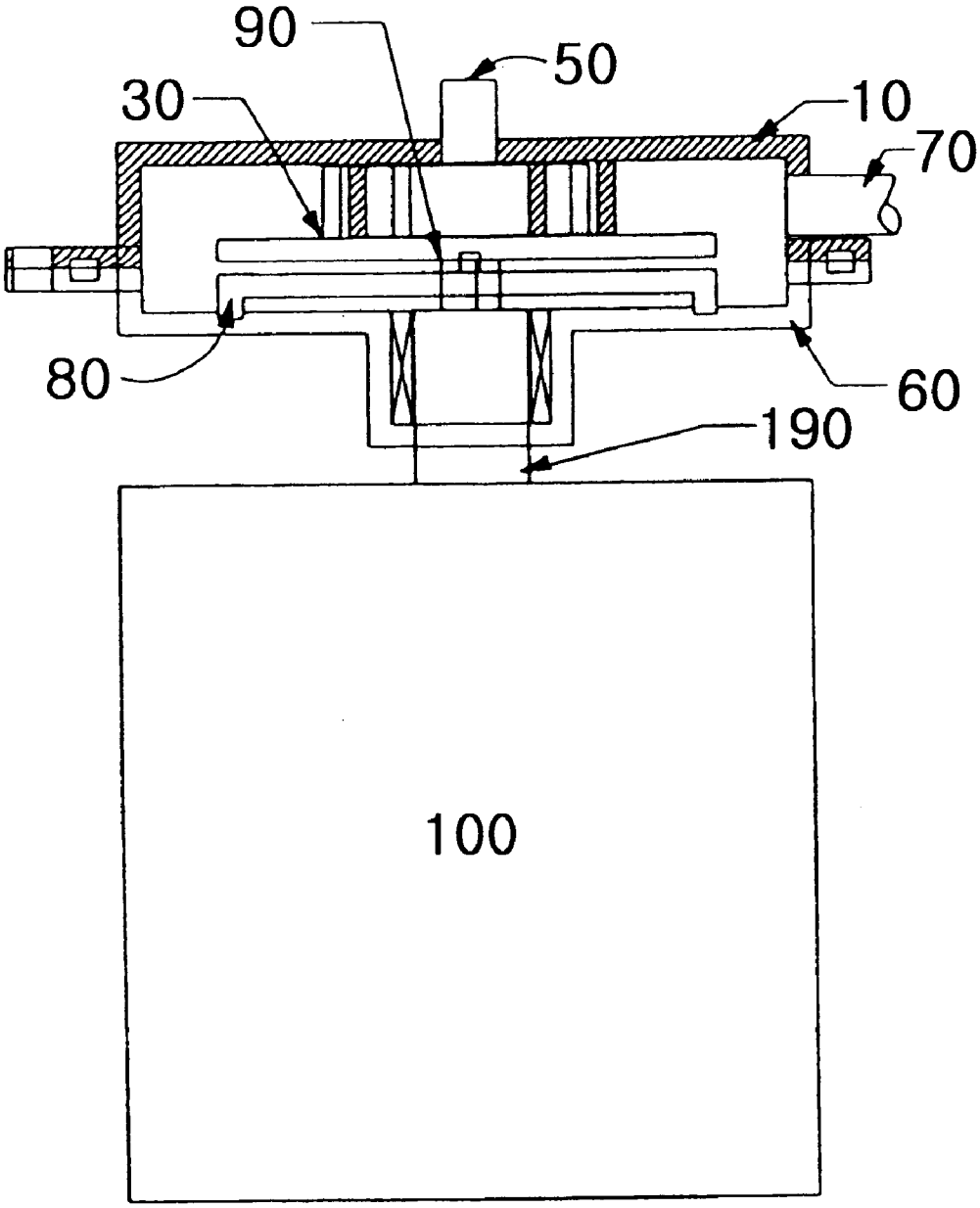
FIG. 3 is a sectional, side elevational view of the scroll pump of the present invention.

FIG. 2 is a plan view of a scroll pump of the present invention, and FIG. 3 is a sectional, side elevational view of the scroll pump of the present invention.

As shown in the drawings, particularly FIGS. 2 and 3, the scroll pump of the present invention comprises a fixed scroll 10, an orbiting scroll 30 which orbits according to the driving force of a motor 100 and contacts the fixed scroll 10, an inlet port 50 formed in the middle of the upper side of the fixed scroll 10 so as to influx the incompressible hydraulic fluid to the inside of the pump, a pressure chamber 33 formed on the outside of the orbiting scroll 30 for raising the pressure of the incompressible hydraulic fluid, and an outlet port 70 formed on the side of the fixed scroll 10 for pumping the incompressible hydraulic fluid to the outside of the scroll pump.

In the operation of the scroll pump, the driving force of the driving shaft 190 transferred from the motor 100 is transmitted to the orbiting scroll 30 through an eccentric shaft 90. Thus, the orbiting scroll 30 orbits while contacting the fixed scroll 10, and orbits with a radius which is the same as the eccentric distance of the eccentric shaft 90 to center of the fixed scroll 10. Here, a revolution preventing apparatus 80 is installed between the orbiting scroll 30 and a casing 60 to prevent the orbiting scroll 30 from revolving on its own axis, whereby the orbiting scroll 30 is orbiting.

Therefore, if the incompressible hydraulic fluid enters through the inlet port 50 into the inside of the fixed scroll 10 and the orbiting scroll 30, the contact part of the orbiting scroll 30 with the fixed scroll 10 is moved along in the orbiting direction in accordance with orbiting of the orbiting scroll 30. The uncompressible hydraulic fluid thus enters into the inside of the pump and along with the contact part flows into the space between the fixed scroll 10 and the orbiting scroll 30.

That is to say, at the time, when the orbiting scroll 30 makes one orbit, the position of the contact part is located at each edge of the fixed scroll 10 and the orbiting scroll 30. Therefore, the incompressible hydraulic fluid is confined to a certain volume such as the pumping space P. If the orbiting scroll 30 is orbiting continuously, the contact part of the edge of both scrolls disappears, the contact part of the inside edge is moved to the outside, and the incompressible hydraulic fluid is moved to the outside.

Furthermore, the incompressible hydraulic fluid moved to the outside is not pumped out at once, but rather it is pumped through the outlet port 70 at a later time after its pressure is increased by the pressure chamber 33. At this time, in addition to the fact that the pumping efficiency is improved by the centrifugal force of the incompressible hydraulic fluid, any resistance force will not apply to the contact part to reduce the volume of the fluid effused and further to make the pressure easily increased.

Figure 4:
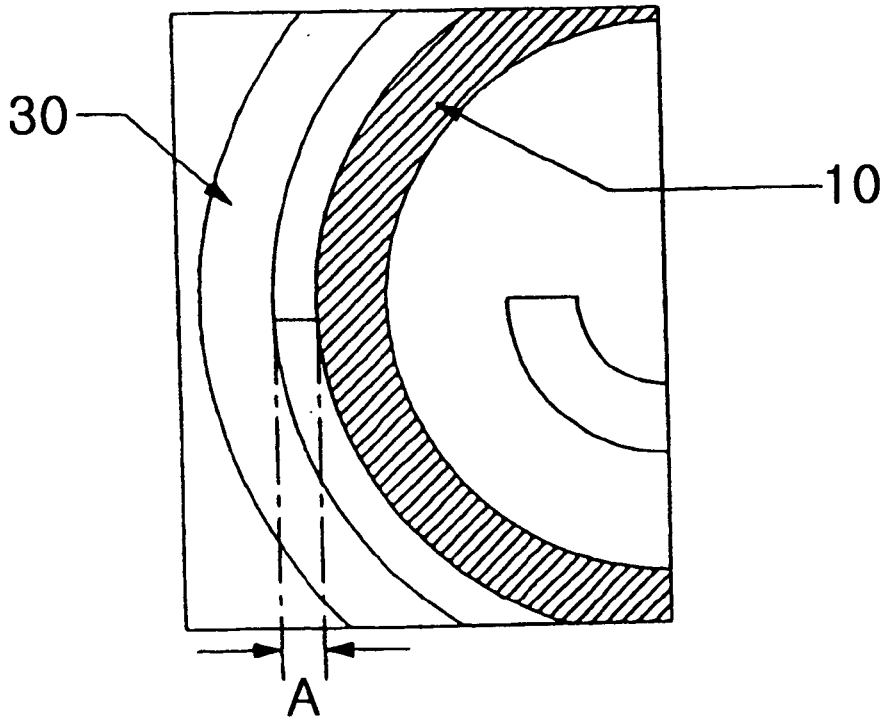
FIG. 4 is a view showing the horizontal clearance between scrolls in the scroll pump according to the present invention.
Figure 5:
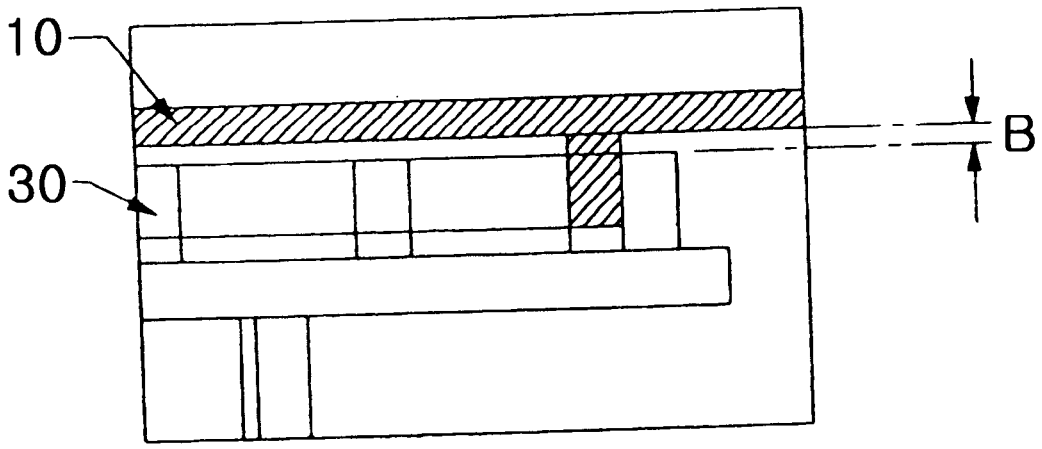
FIG. 5 is a view showing the vertical clearance between scrolls in the scroll pump according to the present invention.

Moreover, as shown in FIG. 4 and FIG. 5, a constant distance A, B are maintained horizontally and vertically between the fixed scroll 10 and the orbiting scroll 30, so that the effusion of the incompressible hydraulic fluid is prevented.

In the above mentioned scroll pump, when the pumping of the scroll pump is conducted, the inlet port 50 and the outlet port 70 are formed to discharge the incompressible hydraulic fluid from the inside to the outside so that the seal efficiency of both scrolls is improved by the centrifugal force of the incompressible hydraulic fluid. And as the lubricating function is improved, the problem of abrasion caused by the contact between both scrolls is solved.

Furthermore, the space for raising the pressure of the incompressible hydraulic fluid is ensured so that it is effective in raising the pumping pressure of the scroll pump.

It is further understood by those skilled in the art that the foregoing description is a preferred embodiment of the disclosed device and that various changes and modifications may be made in the invention without departing from the spirit and scope thereof.

What is claimed is:

1. A scroll pump comprising:

a fixed scroll, an orbiting scroll orbiting with a radius which is the same as the eccentric distance of an eccentric shaft to the center of the fixed scroll and contacting the fixed scroll, wherein the orbiting scroll and the fixed scroll have a constant horizontal and vertical spacing therebetween, an inlet port formed in the middle of the upper side of the fixed scroll to influx incompressible hydraulic fluid into the scroll pump, a pressure chamber formed at the outside of the orbiting scroll to raise the pressure of the incompressible hydraulic fluid, and an outlet port formed at the side of the fixed scroll to discharge the incompressible hydraulic fluid from the scroll pump.

* * * * *